United States Patent [19]

Curran et al.

[11] 4,442,787

[45] Apr. 17, 1984

[54] BOAT PLATFORM HAVING OUTBOARD AND INBOARD POSITIONS

[76] Inventors: Steven H. Curran, 7514 W. 91st St., Los Angeles, Calif. 90045; Alfred G. Kumalae, 2626 Clay, Newport Beach, Calif. 92660

[21] Appl. No.: 343,779

[22] Filed: Jan. 29, 1982

[51] Int. Cl.[3] ..... B63B 17/00

[52] U.S. Cl. ..... 114/363; 297/217; 297/335

[58] Field of Search ..... 114/39, 123, 363, 362, 114/343; 297/15, 331, 335, 217

[56] References Cited

U.S. PATENT DOCUMENTS 289,208 11/1883 Besosa ..... 114/123

2,712,293 7/1955 O'Higgins ..... 114/39 X 4,030,436 6/1977 Stöbel ..... 114/363 X

*Primary Examiner*—Sherman D. Basinger

*Attorney, Agent, or Firm*—Herzig, Schaap & Yanny

[57] ABSTRACT

A seat for sailboats movable between an inboard position and an outboard position which is outboard of a gunwale. The appurtenance is constructed by way of a tubular frame with a fabric member attached to the frame by lacings. The frame has a C-shaped configuration with curved or generally L-shaped legs whose ends are hinged to brackets inside the boat spaced below the gunwale with a seat part which comes flush against the bottom of the boat in the inboard stowed position of the appurtenance.

6 Claims, 6 Drawing Figures

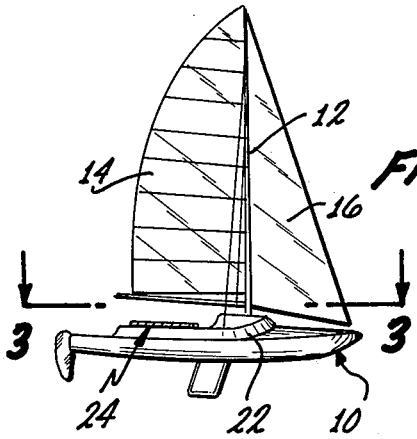
Fig. 1
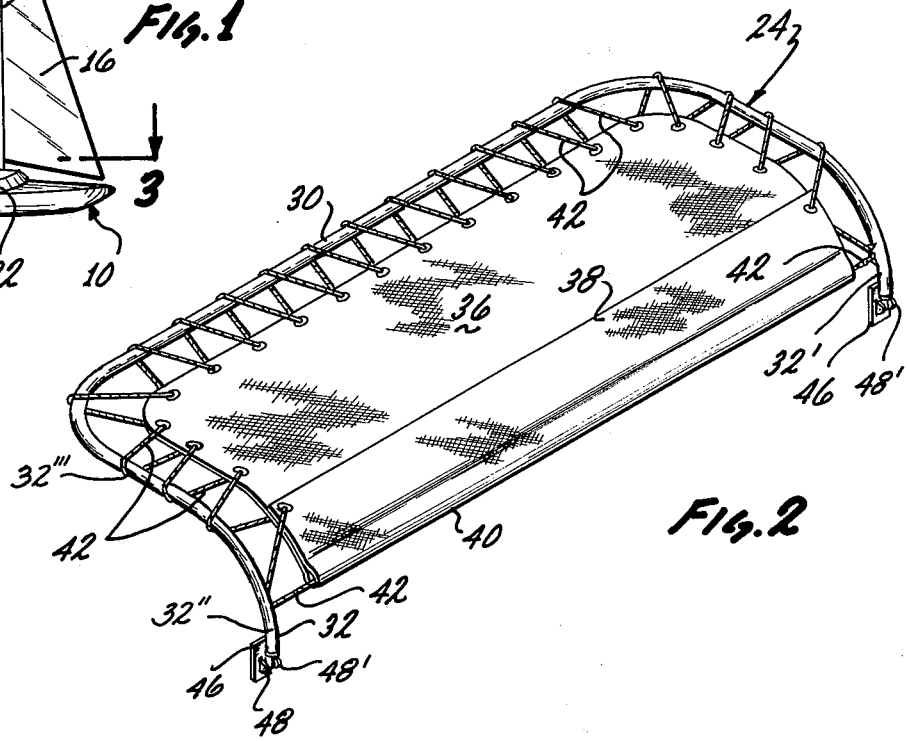
Fig. 2
Fig. 3
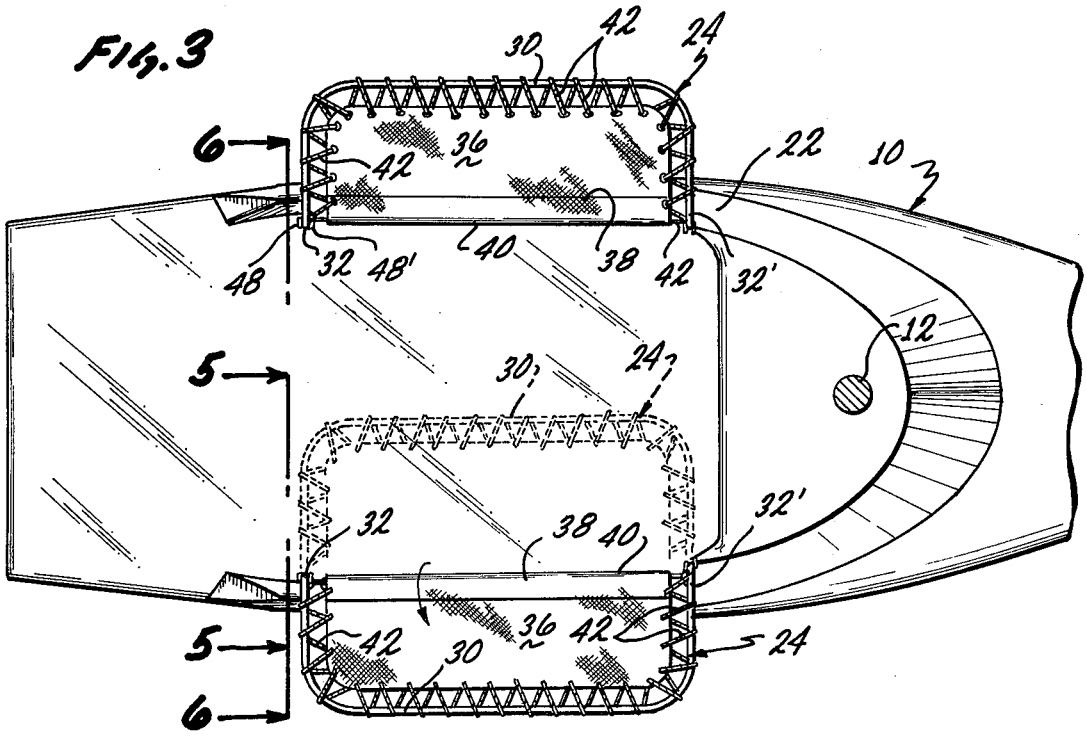

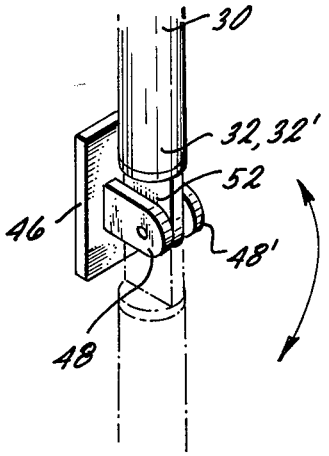
FIG. 4
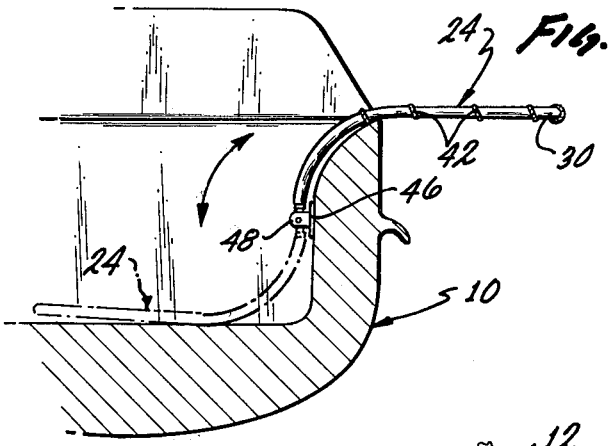
FIG. 5
FIG. 6
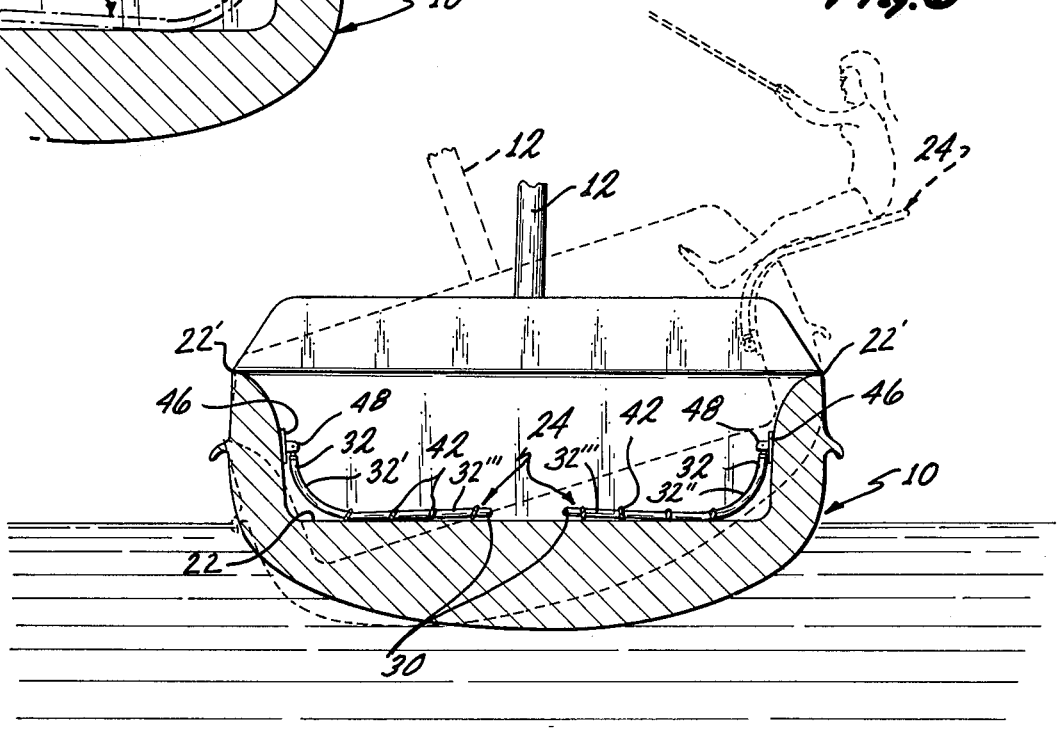

BOAT PLATFORM HAVING OUTBOARD AND INBOARD POSITIONS

BACKGROUND OF THE INVENTION

1. Field of the Invention

The field of the invention is that of an appurtenance, equipment, or facility for boats, more particularly sail boats. The invention is particularly concerned with an appurtenance which provides a seat platform and which is mounted to be movable between an outboard position overhanging a side of gunwhale of the boat, to an inboard position wherein it is flush against the bottom of the boat, (ie) preferably mate with and is supported against the adjacent hull structure.

2. Description of the Prior Art

Many different types of sailing craft in the form of small boats are contemporarily known. These boats may be equipped with various different types of sailing rigs.

A boat equipped with sails while sailing normally heels over towards the leeward side, that is, away from the windward or weather side. Typically in order to compensate for the heel, or to limit the degree of heeling in a fresh breeze one or more of the crew members will position themselves on the side or gunwhale or rail at the windward side of the boat and then lean outward to a substantial extent, so that the weight of the crew member will compensate for and limit the heeling. At such times the crew member usually will grasp a line attached to a mast or otherwise in order to hold his/her position for safety.

The position of a crew member as described is not particularly comfortable and may of course, be dangerous depending on, of course, the type of boat, the wind conditions, and the seafaring experience of the crew member.

The prior art has not provided an appliance or a facility to provide for comfortably accommodating a crew member to position his/her weight in a manner seeking to counter-balance the heeling of the boat or vessel. The herein invention meets the unfilled need. A detailed description of an exemplary form of the invention is provided herein.

SUMMARY OF THE INVENTION

A preferred exemplary form of the invention is described in detail hereinafter. In the preferred form there is provided a seat platform which includes a rigid frame member. Preferably the frame member may be formed of tubing. It is generally rectangular having end portions which are bent or curved and which are hinged to fittings on the inside of a side of the boat. Preferably the platform is constructed as a trampoline. A section of fabric is provided within the frame member, the fabric having peripheral eyelets and being secured to the frame member by lacings, so that the fabric member provides resilience or flexibility with respect to weight placed on it.

The seat platform can be swung or rotated about its hinged mountings so that it extends to an outboard position outboard of the boat over the side or gunwhale of the boat. The seat platform can be rotated about the hinged mounting to an inboard position wherein the major portion of the seat platform rests flush on the bottom of the boat, the hinged mounting of the frame member being at a position to accommodate the seat platform coming into this stowed position within the boat.

In the light of the foregoing the primary object of the invention is to make available a new product or article in the form of a self stowing seat platform constructed for mounting so that in one position it overhangs the side of the boat providing a seat for a crew member and in another position comes into a self stowing position flush against the bottom of the boat.

A further object is to realize an article or product as in the foregoing wherein the seat platform includes a rigid peripheral frame member having bent or curved ends hinged at a position on the inside of the side of the boat so that the article can be swung readily between its outboard and inboard positions.

A further object is to realize an article as in the foregoing which is constructed in the form of a trampoline, the article including a section of fabric within the rigid frame having eyelets and lacings securing it to the rigid frame whereby an appropriate degree of resilience or flexibility is provided.

A further object is to realize an article as in the foregoing which enables the use of larger and more efficient sailing rigs.

Further objects and additional advantages of the invention will become apparent from the following detailed description and annexed drawings.

BRIEF DESCRIPTION OF THE DRAWINGS

FIG. 1 is a pictorial view of a sail boat having the article of the invention installed in it;

FIG. 2 is an isometic view of a preferred form of the invention;

FIG. 3 is a plan view of a boat having two of the articles of the invention installed on it;

FIG. 4 is a detail isometic view showing the hinged mounting of the frame of the seat platform;

FIG. 5 is a partial cross section taken along the line 5—5 of FIG. 3;

FIG. 6 is a schematic cross sectional view illustrating the utilization of the seat platform of the invention.

DESCRIPTION OF THE PREFERRED EMBODIMENT AND BEST MODE OF PRACTICE

Referring to FIG. 1 of the drawings in this figure there is shown a sailing boat having a hull 10, and mast 12. It has a main sail 14, and fore sail 16. The boat may have a keel or center board and a rudder as shown. As shown the hull has a cowl around the cockpit as designated at 22. The boat may or may not have a cowl. The article of the invention is shown in an installed position as designated by the numeral 24. The top of the cowl or coaming is designated at 22.

FIG. 2 shows a preferred form of construction of the article. Numeral 30 designates a rigid tubular frame member substantially U-shaped in plan view (FIGS. 2 and 3) having end parts 32 and 32', which are bent or curved as may be seen in the FIGS. 5 and 6 to define a substantially L-shaped configuration in end or cross-sectional view and defining legs 32'' and 32''' pivotally secured at their ends 32 and 32' intermediate the deck and an upper edge of the cockpit, approximately midway thereof, in the vertical dimension, as seen most clearly in FIGS. 5 and 6.

Preferably the article is constructed as a trampoline. It includes a fabric member 36 having peripheral eyelets as shown. Various types of material may be used as the fabric member. It has one side edge folded over as shown at 38 to provide an edge opening or loop as shown at 40. The fabric member 36 is attached to the frame member 30 by lacings as designated at 42, the lacings having a part that extends through the loop 40. As may be seen the article 24 is constructed as a trampoline, the fabric 30 providing a resilient or flexible surface.

The curved ends 32 and 32' of the member 30 are hinged to the inside of a side of the hull as may be seen in FIGS. 4 and 5. Numeral 46 in FIG. 4 designates a bracket secured to the inside of the hull 10, the bracket having extending lugs 48 and 48'. As shown the end part 32 of the frame 30 is flattended as designed at 52 and this part is pivotally attached, that is, hinged between the lugs 48 and 48'. The end part 32' of the frame 30 is hinged to a similar bracket carried on the inside of the side of the hull. As may be seen the seat platform member may be swung between outboard and inboard positions as illustrated in FIGS. 3, 5, and 6. As may be seen the configuration of frame 30 is such that it conforms to the contour of the hull to mate therewith in both positions.

The L-shaped configuration of frames 30, when pivoted at their respective ends 32, is thus self-supported and cantilevered in the upper outward position of FIG. 5, the dotted position at 24 in FIG. 6; in view of said central pivotal mounting 48, the frames 30 are cantilevered outward, as shown in FIG. 6 in dotted outline, and in that posture engage the adjacent boat structure for reinforcement and support, enabling it to sustain the weight of the crew. Conversely in the inboard position, said frame members 30 engage and are supported against the adjacent wall and floor structure of the cockpit, lining the same and providing support thereagainst.

The utilization of the article is illustrated in FIGS. 3, 5, and 6. FIG. 3 is a plan view illustrating two of the seat platforms installed in a boat, one on each side opposite each other. As previously mentioned they may be installed over the cowl or the hull may be one without a cowl around the cockpit. As illustrated in FIGS. 5 and 6, the article is mounted directly over the gunwhale.

FIG. 5 shows the article in an outboard position extending outwardly over the gunwhale and providing a seat for a crew member, the dotted line position showing the article swung about its hinges into an inboard position wherein it comes flush with the bottom of the boat. When the article is in the outboard position as illustrated in FIGS. 5 and 6 it provides a seat or seat platform for a crew member in a position wherein the crew member's weight provides leverage to offset the heeling of the boat to the leeward side. Thus, the crew member is in a comfortable position and comfortably seated, rather than hanging over the side of the boat. When not in use in this manner, the article can be readily rotated about its hinges into a self stowing position as illustrated in FIG. 6, wherein it comes flush against the bottom of the boat or floor of the cockpit. In this position it can serve as seat or bed. In this position it reduces the overall beam of the boat and facilitates trailering.

From the foregoing those skilled in the art will readily understand the nature, construction, and utilization of the invention and the manner in which it achieves and realizes all of the objects as set forth in the foregoing.

The foregoing disclosure is representative of a preferred form of the invention and is to be interpreted in an illustrative rather than a limiting sense, the invention to be accorded the full scope of the claims appended hereto.

We claim:

1. As an article of manufacture, an appurtenance for a boat having a hull with sides including an upper edge and a cockpit having a floor, in combination, a frame means comprising a self stowable and extendable seat platform, means providing a hinged mounting of the frame to the side of the boat whereby the frame means can be rotated about the hinged mounting to an outboard position extending outwardly from the side of the boat and can be roatated to an inward position inboard of the boat, the hinged mounting being positioned substantially midway between the upper edge of a side and the floor, the frame means having substantially L-shaped end portions shaped to contour to the inside and top of the side of the boat whereby in the outboard position it is supported in cantilevered posture solely by the side of the boat, and whereby in the inboard position said frame means is nested against the floor and an inner side of the boat as and for a seat and backrest therein.

2. An article as in claim 1 wherein the said portions have curved parts adjacent to the hinged mounting accommodating movement of the frame means to the outboard position outward from the side of the boat, the said portions being configurated whereby the frame means can be rotated whereby the said frame means is positioned against the floor of the boat.

3. An article as in claim 2, including brackets on the inside of the boat, the frame means including a rigid peripheral member, the said portions being hinged to the said brackets.

4. An article as in claim 2, wherein the frame means is constructed as a trampoline, the frame means having a rigid peripheral member, a fabric member within the peripheral member and lacing means whereby the fabric member is secured to the peripheral member.

5. An article as in claim 2 wherein the frame means is constructed as a trampoline, the frame means having a rigid peripheral member, a fabric member within the peripheral member and lashing means whereby the fabric member is secured to the peripheral member, the frame and fabric member means being conformable to the adjacent inboard side of the boat and floor in either the inboard or outboard position.

6. An article as in claim 1, wherein the frame means is constructed as a trampoline, the frame means having a rigid peripheral member, a fabric member within the peripheral member and lacing means whereby the fabric member is secured to the peripheral member.

* * * * *